US009206375B2

(12) United States Patent
Hayama et al.

(10) Patent No.: US 9,206,375 B2
(45) Date of Patent: Dec. 8, 2015

(54) LUBRICATING GREASE COMPOSITION

(75) Inventors: Makoto Hayama, Chigasaki (JP); Setsuo Sasaki, Kawasaki (JP)

(73) Assignee: KYODO YUSHI CO., LTD., Kanagawa (JP)

( * ) Notice: Subject to any disclaimer, the term of this patent is extended or adjusted under 35 U.S.C. 154(b) by 39 days.

(21) Appl. No.: 14/124,810

(22) PCT Filed: Jul. 23, 2012

(86) PCT No.: PCT/JP2012/068564

§ 371 (c)(1),
(2), (4) Date: Dec. 9, 2013

(87) PCT Pub. No.: WO2013/015236

PCT Pub. Date: Jan. 31, 2013

(65) Prior Publication Data

US 2014/0128300 A1 May 8, 2014

(30) Foreign Application Priority Data

Jul. 22, 2011 (JP) ..... 2011-160960

(51) Int. Cl.
*C10M 169/02* (2006.01)

(52) U.S. Cl.
CPC ..... *C10M 169/02* (2013.01); *C10M 2215/04* (2013.01); *C10M 2215/1026* (2013.01); *C10M 2215/223* (2013.01); *C10M 2215/2203* (2013.01); *C10M 2215/224* (2013.01); *C10M 2215/2245* (2013.01); *C10M 2219/044* (2013.01); *C10M 2219/0406* (2013.01); *C10N 2220/04* (2013.01); *C10N 2230/02* (2013.01); *C10N 2230/08* (2013.01); *C10N 2230/12* (2013.01); *C10N 2230/26* (2013.01); *C10N 2230/32* (2013.01); *C10N 2230/74* (2013.01); *C10N 2240/20* (2013.01); *C10N 2250/10* (2013.01)

(58) Field of Classification Search
CPC ..... C10M 2215/006; C10M 2217/0456
USPC ..... 508/552
See application file for complete search history.

(56) References Cited

U.S. PATENT DOCUMENTS

| | | | | |
|---|---|---|---|---|
| 5,256,321 | A * | 10/1993 | Todd | 508/429 |
| 5,498,357 | A * | 3/1996 | Naka et al. | 508/176 |
| 7,943,557 | B2 * | 5/2011 | Egami | 508/110 |
| 8,183,191 | B2 * | 5/2012 | Kinoshita et al. | 508/528 |
| 8,258,088 | B2 * | 9/2012 | Bodesheim et al. | 508/244 |
| 8,258,089 | B2 * | 9/2012 | Fujinami et al. | 508/421 |
| 8,329,623 | B2 * | 12/2012 | Kawamura | 508/283 |
| 8,455,407 | B2 * | 6/2013 | Schmidt-Amelunxen et al. | 508/128 |
| 8,859,475 | B2 * | 10/2014 | Namiki et al. | 508/552 |
| 2009/0003742 | A1 * | 1/2009 | Nakatani et al. | 384/289 |
| 2010/0105586 | A1 | 4/2010 | Bodesheim et al. | |
| 2010/0187481 | A1 * | 7/2010 | Bodesheim et al. | 252/400.2 |
| 2011/0195880 | A1 * | 8/2011 | Kawamura et al. | 508/144 |
| 2011/0306429 | A1 | 12/2011 | Mikami et al. | |
| 2012/0046204 | A1 | 2/2012 | Yamamoto et al. | |
| 2012/0316091 | A1 * | 12/2012 | Kawamura | 508/100 |

FOREIGN PATENT DOCUMENTS

| | | | |
|---|---|---|---|
| JP | 5-98280 | A | 4/1993 |
| JP | 2003-327990 | A | 11/2003 |
| JP | 2005-154755 | A | 6/2005 |
| JP | 2006-249368 | A | 9/2006 |
| JP | 2007-191523 | A | 8/2007 |
| JP | 2007-211220 | A | 8/2007 |
| JP | 2007-262146 | A | 10/2007 |
| JP | 2008-133309 | A | 6/2008 |
| JP | 2009-29981 | A | 2/2009 |
| JP | 2010-530446 | A | 9/2010 |
| WO | 2009/113677 | A1 | 9/2009 |
| WO | WO 2010/098337 | A1 | 9/2010 |
| WO | WO 2010/131743 | A1 | 11/2010 |

OTHER PUBLICATIONS

International Search Report (PCT/ISA/210) mailed on Oct. 23, 2012, by the Japanese Patent Office as the International Searching Authority for International Application No. PCT/JP2012/068564.

Written Opinion (PCT/ISA/237) mailed on Oct. 23, 2012, by the Japanese Patent Office as the International Searching Authority for International Application No. PCT/JP2012/068564.

Extended European Search Report issued Jun. 8, 2015 in corresponding European Patent Application No. 12817534.6.

* cited by examiner

*Primary Examiner* — Ellen McAvoy
(74) *Attorney, Agent, or Firm* — Buchanan, Ingersoll & Rooney PC

(57) ABSTRACT

The invention provides a lubricating grease composition containing the following components (a) and (b): (a) an ionic liquid having as an anion bis(trifluoromethylsulfonyl)imide; and (b) as a thickener a diurea compound of formula (1): R1NH—CO—NH—R2-NH—CO—NH—R3 (1) wherein R2 is an aromatic hydrocarbon group having 6 to 15 carbon atoms; and R1 and R3, which may be the same or different are each an aromatic hydrocarbon group having 6 to 12 carbon atoms, an alicyclic hydrocarbon group having 6 to 12 carbon atoms or a straight-chain alkyl group having 8 to 20 carbon atoms, with the groups represented by R1 and R3 containing the aromatic hydrocarbon group in an amount of 50 to 100 mol %. The lubricating grease composition of the invention can favorably be used under ultra-high vacuum, and under high temperatures of 200 to 300° C.

9 Claims, No Drawings

LUBRICATING GREASE COMPOSITION

TECHNICAL FIELD

The present invention relates to a lubricant composition that can be used under high vacuum or ultra high vacuum conditions, and also under high temperatures. In particular, the invention relates to a lubricating grease composition usable under high vacuum of 0.1 Pa or less or ultra-high vacuum as in the equipment operated in the outer space (space station), vacuum equipment, semiconductor making equipment (sputtering equipment) and the like; and also usable at high temperatures, i.e., as in the equipment or machines the maximum temperature of which is supposed to increase up to 200 to 300° C. where any conventional organic lubricant cannot be used in consideration of the flame retardant properties and the thermal stability.

BACKGROUND ART

Recently, particular attention has been paid to ionic liquids as the base oil for grease used under high vacuum or ultra high vacuum conditions and under high temperatures (JP 2005-154755 A).

As compared with the lubricant oil, the grease is more suitable for lubricating the rolling bearings because of the advantages of easier attachment to metal materials, a smaller amount to be needed, less leakage and the like. The grease is a semi-solid lubricant comprising a base oil and a thickener. The thickener works to maintain the base oil and keep the semi-solid state.

There are many kinds of ionic liquids. When the polarity of the ionic liquid is strong, there is the drawback that the ionic liquid does not become thickened by the addition of a typical thickener (for example, lithium soap) and does not assume a semi-solid state.

The base oil of grease used in the outer space or under the conditions of high temperatures is required to be insoluble in water, and exhibit appropriate kinetic viscosities from the low temperature region to the high temperature region.

SUMMARY OF INVENTION

Technical Problem

An object of the invention is to provide a grease composition using an ionic liquid as the base oil, which grease composition can advantageously be used under ultra high vacuum conditions, and under high temperatures of 200 to 300° C.

Solution to Problem

The invention provides the following grease composition:

1. A lubricating grease composition comprising;

(a) an ionic liquid having as an anion bis(trifluoromethylsulfonyl)imide, (b) as a thickener a diurea compound of formula (1):

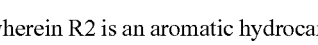

$$R1NH—CO—NH—R2-NH—CO—NH—R3 \quad (1)$$

wherein R2 is an aromatic hydrocarbon group having 6 to 15 carbon atoms; and R1 and R3, which may be the same or different are each an aromatic hydrocarbon group having 6 to 12 carbon atoms, an alicyclic hydrocarbon group having 6 to 12 carbon atoms or a straight-chain alkyl group having 8 to 20 carbon atoms, with the groups represented by R1 and R3 comprising the aromatic hydrocarbon group in an amount of 50 to 100 mol %.

2. The lubricating grease composition as described in the above-mentioned item 1, wherein the ionic liquid (a) has as a cation 1-(2-methoxyethyl)-1-methylpyrrolidinium or 1-butyl-2,3-dimethylimidazolium.

3. The lubricating grease composition as described in the above-mentioned item 1 or 2, wherein the thickener (b) is the diurea compound represented by formula (1) wherein the groups represented by R1 and R3 comprise the aromatic hydrocarbon group in an amount of 100 mol %.

4. The lubricating grease composition as described in any one of the above-mentioned items 1 to 3, further comprising a fatty amine salt in an amount of 0.1 to 5.0 mass %.

Effects of Invention

The grease composition of the invention can be favorably used under ultra-high vacuum and under high temperatures of 200 to 300° C.

DESCRIPTION OF EMBODIMENTS

Ionic Liquid

The ionic liquid used as a base oil in the grease composition of the invention is called "room temperature molten salt", which is a molten salt that assumes a liquid state at room temperatures. The ionic liquid used in the invention is insoluble in water.

In the ionic liquid used in the invention, the anion is bis(trifluoromethylsulfonyl)imide (TFSI). The above-mentioned ionic liquid is hydrophobic and the evaporation loss is small at high temperatures. In contrast to this, tris(pentafluoroethyl)trifluorophosphate (FAP) salt, which is used for comparison in Examples to be described later is also hydrophobic, but the evaporation loss is large at high temperatures. The evaporation loss can be determined by using TG-DTA.

The cation is not particularly limited, but may preferably be 1-(2-methoxyethyl)-1-methylpyrrolidinium, 1-butyl-2,3-dimethylimidazolium or methyl trioctylammonium. Of the above, 1-(2-methoxyethyl)-1-methylpyrrolidinium or 1-butyl-2,3-dimethylimidazolium is preferable, and in particular, 1-(2-methoxyethyl)-1-methylpyrrolidinium is preferred.

The ionic liquid having bis(trifluoromethylsulfonyl)imide as the anion and 1-(2-methoxyethyl)-1-methylpyrrolidinium as the cation is the most preferable in the invention.

The ionic liquid used in the invention may preferably have a kinetic viscosity at −20° C. of less than 7000 $mm^2/s$, and a kinetic viscosity at −40° C. of less than 10000 $mm^2/s$. In general, the working temperature range of the lubricant for the outer space use is designed from −20° C. to 80° C., preferably from −40° C. to 80° C. When the kinetic viscosity at −20° C. is less than 7000 $mm^2/s$, and the kinetic viscosity at −40° C. is less than 10000 $mm^2/s$, the flowability of the grease composition is sufficient enough to be used under low temperatures as mentioned above. Currently, only fluorinated oils can be used at −40° C. as the base oil for grease designed for vacuum use. However, the radiation resistance of the fluorinated oils is so poor that decomposition of the base oil is recognized upon the exposure to radiation. Alkylcyclopentane oil (MAC oil), which is also used as the base oil for vacuum use is excellent in the radiation resistance, but difficult to be used because of the high kinetic viscosity at −40° C. The viscosity becomes lower at high temperatures. So, the kinetic viscosity of the ionic liquid at 100° C. was defined for allowing a margin of temperature, although the upper limit temperature is expected to be 80° C. in the intended application. In defining the kinetic viscosity, the kinetic viscosity values of poly α-olefins (with low viscosity) that are low-viscosity lubricant oils used without any hindrance in the field of general industries were applied to the criteria. The kinetic viscosity of the ionic liquid may preferably be 4 $mm^2/s$ or more at 100° C. When the kinetic viscosity is less than 4 $mm^2/s$, the oil film thickness becomes insufficient at high temperatures and it is therefore hard to maintain a good lubricating condition.

When consideration is given to the use in the outer space, the radiations such as α-rays, β-rays, γ-rays and the like are falling onto the synchronous orbit. In particular, the γ-rays exhibit the highest penetration, so that the γ-rays can penetrate a 1-mm-thick aluminum wall without being blocked. There is a possibility of the exposure to the radiation dose as large as about $10^5$ Gy for 10 years. In light of this, the grease not susceptible to the γ-ray radiation is desired. The grease comprising the ionic liquid according to the invention is preferable because the composition does not change when exposed to the γ-rays.

The ionic liquid having 1-(2-methoxyethyl)-1-methylpyrrolidinium as the cation can be provided with almost the same kinetic viscosity at −40° C. as that of the fluorine-based oil, and at the same time, excellent radiation resistance.

Thickener

As the thickener for use in the invention, the diurea compound of formula (1) can be used:

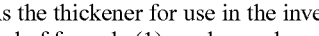

$$R1NH—CO—NH—R2-NH—CO—NH—R3 \quad (1)$$

In the formula (1), R2 is an aromatic hydrocarbon group having 6 to 15 carbon atoms; and R1 and R3, which may be the same or different are each an aromatic hydrocarbon group having 6 to 12 carbon atoms, an alicyclic hydrocarbon group having 6 to 12 carbon atoms or a straight-chain alkyl group having 8 to 20 carbon atoms, with the groups represented by R1 and R3 comprising the aromatic hydrocarbon group in an amount of 50 to 100 mol %.

The aromatic hydrocarbon group accounts for 50 to 100 mol %, preferably 75 to 100 mol %, and more preferably 100 mol %, based on the total groups represented by R1 and R3 in formula (1). When the aromatic hydrocarbon group is contained in an amount of less than 50 mol %, the flowability of the resultant grease becomes so high that the grease is not suitable for lubricating the bearing or the like if the amount of thickener is somewhat small. When the amount of thickener is increased, the ratio of base oil is increased, which disadvantageously increases the stirring resistance of the resultant grease.

The content of the thickener, which is such an amount that is effective for forming the lubricant composition into a semi-solid state may preferably be 1 to 30 mass %, and more preferably 5 to 30 mass %, based on the total mass of the grease composition. Too much thickener makes the resultant grease hard, which may increase the resistance to stirring. On the other hand, when the amount of thickener is too small, the resultant grease becomes softened, which produces the risk of leakage.

The diurea compound represented by formula (1) as the thickener is typically obtainable from a reaction between diisocyanate and monoamine.

Examples of the diisocyanate that constitutes the group of R2 after completion of the above-mentioned reaction include aromatic isocyanates such as 2,4-tolylene diisocyanate, 2,6-tolylene diisocyanate, diphenylmethane-4,4'-diisocyanate, naphthalene-1,5-diisocyanate, mixtures thereof and the like. In particular, diphenylmethane-4,4'-diisocyanate is preferred.

Examples of the monoamine that constitutes the groups of R1 and R3 include aromatic amines such as aniline, benzylamine, toluidine, chloroaniline and the like; straight-chain amines such as octylamine, nonylamine, decylamine, undecylamine, dodecylamine, tridecylamine, tetradecylamine, pentadecylamine, hexadecylamine, heptadecylamine, octadecylamine, nonyldecylamine, eicosylamine and the like; alicyclic amines such as cyclohexylamine and the like; and mixtures thereof. Particularly, toluidine is preferred as the aromatic amine. As the straight-chain amine, octylamine, decylamine, dodecylamine, and octadecylamine are preferred. As the alicyclic amine, cyclohexylamine is preferable.

The inventors of the present invention found that when the ionic liquid having the TFSI anion is used as the base oil, the Li soap or the typical thickener such as an aliphatic diurea compound having an alkyl group at the end does not exhibit sufficient thickening performance, but the diurea compound having an aromatic component at the end group, that is, R1 and/or R3 in the formula (1) can exhibit increased thickening performance. Without wishing to be bound by any theory, it is considered that the Li soap and the thickener having an alkyl group at the end are suitable for the base oil having a weak polarity, but cannot easily form a three-dimensional network structure for retaining base oil when used in the ionic liquid if the ionic liquid has a strong polarity because of the presence of TFSI anion.

Additives

The lubricating grease composition of the invention may further comprise additives commonly used for typical lubricating grease compositions, for example, a rust inhibitor, antioxidant, extreme pressure agent, surfactant and the like. Addition of the rust inhibitor is desirable.

Rust Inhibitor

The rust inhibitor that may be used in the invention is a fatty amine salt. To be more specific, salts prepared from a fatty acid having 1 to 22 carbon atoms, preferably 1 to 20 carbon atoms and an amine can be used. The fatty acid may be saturated or unsaturated, and straight-chain or branched. The amine may be a primary, secondary or tertiary amine, having an aliphatic, alicyclic or aromatic group as the functional group.

When the rust inhibitors conventionally used for lubricant compositions, such as a sulfonate, fatty amide, compound having two or more nitrogen atoms, succinic acid ester, succinic acid half ester, nitrite, molybdate, dibasic acid salt and the like are added to the grease composition of the invention, development of rust is recognized. The effect of those rust inhibitors is found to be insufficient. In addition, it is found that the sulfonate, nitrite, molybdate and dibasic acid salt cause sedimentation and separation in the ionic liquid, without dissolving therein.

The content of the fatty amine salt rust inhibitor may preferably be in the range of 0.05 to 5.0 mass %, more preferably 0.1 to 1.5 mass %, based on the total mass of the grease composition according to the invention.

Worked Penetration

The worked penetration of the grease composition according to the invention may be preferably 220 to 385, and more preferably 250 to 340. When the worked penetration exceeds 385, the leakage will often occur. With the worked penetration of less than 220, the resistance to stirring will increase.

EXAMPLES

Preparation of Test Grease Compositions

Grease compositions were prepared using the components as shown in Tables 1 and 2, and then the physical properties of the obtained grease compositions were evaluated in accordance with the methods shown below.

Examples and Comparative Examples 1 and 2

A half amount of ionic liquid and the whole quantity of diisocyanate as shown in Tables 1 and 2 were placed in a first container and heated to 70 to 80° C. The rest half of the ionic liquid and the whole quantity of monoamine were placed in a second container and heated to 70 to 80° C., and the resultant mixture was added to the first container, with stirring. The stirring operation was continued for about 30 minutes while the temperature of the reactant was increasing because of the exothermic reaction. After the reaction was sufficiently conducted, the reaction mixture was heated and then maintained at 155 to 175° C. for 30 minutes. The reaction mixture was cooled and kneaded using a three-roll mill, thereby obtaining the intended grease.

The rust inhibitor was further added, and kneaded with a three-roll mill to obtain the intended grease in Examples 2-1 and 2-3.

Comparative Examples 3 and 4

The whole amount of ionic liquid and the whole amount of thickener as shown in Tables 1 and 2 were placed in a container and heated to about 200 to 210° C. with stirring. As a result, the thickener did not completely dissolve. The above-mentioned temperatures ranging from 200 to 210° C. are the temperature region where the thickeners can completely dissolve in the course of preparation of the typical grease containing a general-purpose base oil such as a mineral oil or the like instead of the ionic liquid.

Comparative Example 5

Commercially available MAC oil type grease (containing additives): Rheolube 2000, made by Nye Lubricants, Inc.

Comparative Example 6

Commercially available fluorinated oil type grease: Braycote 601 EF, made by Solvay.

TEST METHODS

1. Low Evaporation Properties of Base Oil

The low evaporation properties can be evaluated by the test of low vapor pressure performance in a vacuum.

The evaporation loss (%) of a sample (10 mg) was determined in accordance with the TG-DTA.

Test conditions: The evaporation loss was determined under an atmosphere of $N_2$ with the temperature being maintained at 280° C. The test duration time was 10 hours.

o: evaporation loss of 22% or less x: evaporation loss of more than 22%

2. Worked penetration (JIS K2220.7)

3. Low-temperature viscosities (−20° C. and −40° C.) of base oil (JIS K2283)

Kinetic viscosity of base oil (at −20° C.)

o: less than 7000 $mm^2/S$ x: 7000 $mm^2/S$ or more

Kinetic viscosity of base oil (at −40° C.)

o: less than 10000 $mm^2/S$ x: 10000 $mm^2/S$ or more

4. Radiation Resistance of Base Oil

The state of base oil was evaluated by infrared spectroscopic analysis after the base oil was exposed to $Co^{60}$-γ at a dose of $10^5$ Gy.

o: There was no change in the state of base oil. (no change in the infrared spectroscopic analysis)

x: Some change was observed. (Generation of gas supposed to result from decomposition)

5. Rust preventing properties in a humidity cabinet test (in accordance with JIS K2246)

Each sample grease was coated on an SUS440C stainless steel sheet (60×80×1 mm) and subjected to the test. The test was conducted at 49° C. and 95% RH for 14 days.

o: Acceptable (No rust was observed.)

x: Some rust was observed.

6. Water Insolubility

Each ionic liquid was added to water at a ratio (by volume) of 0.1:1, and the resultant mixture was stirred. It was visually inspected whether the ionic liquid was insoluble in water, or not. The ionic liquid and water were both adjusted to 25° C.

o: water insolubility (insoluble in water)

x: water solubility (soluble in water)

TABLE 1

| | | Example 1-1 | Example 1-2 | Example 1-3 | Comp. Example 1 | Comp. Eample 2 | Comp. Example 3 | Comp. Example 4 | Comp. Example 5 | Comp. Example 6 |
|---|---|---|---|---|---|---|---|---|---|---|
| Ionic liquid | Anion | TFSI | TFSI | TFSI | FAP | TFSI | TFSI | TFSI | Commercially available MAC oil type grease | Commercially available fluorinated grease |
| | Cation | A | B | C | A | A | A | A | | |
| Thickener | Type | Urea | Urea | Urea | Urea | Urea | Li-t | Li-12OHSt | | |
| | diisocyanate | diphenylmethane-4,4'-diisocyanate | diphenylmethane-4,4'-diisocyanate | diphenylmethane-4,4'-diisocyanate | diphenylmethane-4,4'-diisocyanate | diphenylmethane-4,4'-diisocyanate | — | — | | |
| | monoamine | p-toluidine | p-toluidine | p-toluidine | p-toluidine | octylamine | — | — | | |
| Thickener | | 16 mass % | 16 mass % | 16 mass % | 16 mass % | 10 mass % | 15 mass % | 16 mass % | | |
| Low evaporation properties of base oil | | ○ | ○ | ○ | X | ○ | ○ | ○ | X | ○ |
| Worked penetration | | 265 | 280 | 280 | 280 | X | X | X | 276 | 280 |
| Kinetic viscosity of base oil at low temp. (−20° C.) | | ○ | ○ | Δ | ○ | ○ | ○ | ○ | ○ | ○ |
| Kinetic viscosity at base oil at low temp. (−40° C.) | | ○ | Δ | Δ | Δ | ○ | ○ | ○ | Δ | ○ |

TABLE 1-continued

| | Example 1-1 | Example 1-2 | Example 1-3 | Comp. Example 1 | Comp. Eample 2 | Comp. Example 3 | Comp. Example 4 | Comp. Example 5 | Comp. Example 6 |
|---|---|---|---|---|---|---|---|---|---|
| Radiation resistance of base oil | ○ | ○ | ○ | ○ | ○ | ○ | ○ | ○ | X |
| Water insolubility of base oil | ○ | ○ | ○ | ○ | ○ | ○ | ○ | — | — |

| | | | |
|---|---|---|---|
| Ionic liquid | Anion | TFSI | bis(trifluoromethylsulfonyl)imide ($(CF_3SO_2)_2N^-$) |
| | | FAP | tris(pentafluoroethyotrifluorophosphate |
| | Cation | A | 1-(2-methoxyethyl)-1-methylpyrrolidinium |
| | | B | 1-butyl2,3-dimethylimidazolium |
| | | C | methyltrioctyl ammonium |

TABLE 2

| | | Example 2-1 | Example 2-2 | Example 2-3 |
|---|---|---|---|---|
| Ionic liquid | Anion | TFSI | TFSI | TFSI |
| | Cation | A | A | A |
| Thickener | Type | Urea | Urea | Urea |
| | diisocyanate | diphenyl-methane-4,4'-diisocyanate | diphenyl-methane-4,4'-diisocyanate | diphenyl-methane-4,4'-diisocyanate |
| | monoamine | p-toluidine | p-toluidine | p-toluidine |
| Rust inhibitor | | A | — | B |
| Rust prevention properties | | ○ | X | X |

Rust inhibitor
A fatty amine salt
B sulfonate

The invention claimed is:

1. A lubricating grease composition comprising;

(a) an ionic liquid having as an anion bis(trifluoromethylsulfonyl)imide, (b) as a thickener a diurea compound of formula (1):

$$R1NH—CO—NH—R2-NH—CO—NH—R3 \quad (1)$$

wherein R2 is an aromatic hydrocarbon group having 6 to 15 carbon atoms; and R1 and R3, which may be the same or different are each an aromatic hydrocarbon group having 6 to 12 carbon atoms, an alicyclic hydrocarbon group having 6 to 12 carbon atoms or a straight-chain alkyl group having 8 to 20 carbon atoms, with the groups represented by R1 and R3 comprising the aromatic hydrocarbon group in an amount of 50 to 100 mol %, wherein the ionic liquid (a) has 1-(2-methoxyethyl)-1-methylpyrrolidinium or 1-butyl-2,3-dimethylimidazolium as a cation.

2. The lubricating grease composition of claim 1, wherein the ionic liquid (a) has 1-(2-methoxyethyl)-1-methylpyrrolidinium.

3. The lubricating grease composition of claim 1, wherein the thickener (b) is the diurea compound represented by formula (1) wherein the groups represented by R1 and R3 comprise the aromatic hydrocarbon group in an amount of 100 mol %.

4. The lubricating grease composition of claim 1, further comprising a fatty amine salt in an amount of 0.1 to 5.0 mass %.

5. The lubricating grease composition of claim 2, wherein the thickener (b) is the diurea compound represented by formula (1) wherein the groups represented by R1 and R3 comprise the aromatic hydrocarbon group in an amount of 100 mol %.

6. The lubricating grease composition of claim 2, further comprising a fatty amine salt in an amount of 0.1 to 5.0 mass %.

7. The lubricating grease composition of claim 3, further comprising a fatty amine salt in an amount of 0.1 to 5.0 mass %.

8. The lubricating grease composition of claim 5, further comprising a fatty amine salt in an amount of 0.1 to 5.0 mass %.

9. The lubricating grease composition of claim 3, wherein the thickener (b) is the diurea compound represented by formula (1) wherein R1 and R3 represent a tolyl group.

* * * * *